United States Patent [19]

Wood

[11] 4,176,358

[45] Nov. 27, 1979

[54] REFLECTOR ANTENNA WITH MATCHED FEED SYSTEM

[75] Inventor: Peter J. Wood, Chelmsford, England

[73] Assignee: The Marconi Company Limited, Chelmsford, England

[21] Appl. No.: 852,483

[22] Filed: Nov. 17, 1977

[30] Foreign Application Priority Data

Nov. 18, 1976 [GB] United Kingdom ..... 48030/76

[51] Int. Cl.[2] ..... H01Q 19/14

[52] U.S. Cl. ..... 343/782; 343/781 CA

[58] Field of Search ..... 343/781 R, 781 P, 781 CA, 343/782, 840

[56] References Cited

U.S. PATENT DOCUMENTS

| | | | |
|---|---|---|---|
| 2,607,010 | 8/1952 | Kock | 343/782 |
| 4,031,538 | 6/1977 | Lundgren | 343/781 CA |

FOREIGN PATENT DOCUMENTS

| | | | |
|---|---|---|---|
| 1033536 | 7/1953 | France | 343/781 |

*Primary Examiner*—Eli Lieberman

*Attorney, Agent, or Firm*—Diller, Ramik & Wight

[57] ABSTRACT

A reflector antenna is provided with two sets of perturbation reflectors, in the form of annular surface depressions, to reduce the effect of 'external reflection' which is caused by energy re-entering a feed horn after reflection from the antenna. The two sets of perturbation reflectors are arranged to produce vector cancellation at two operating frequency bands.

10 Claims, 5 Drawing Figures

REFLECTOR ANTENNA WITH MATCHED FEED SYSTEM

This invention relates to a reflector antenna consisting of a reflector arranged to be illuminated by a prime feed system.

The feed system may illuminate a main reflector directly or indirectly via a sub-reflector in which latter case the reflector with which the invention is concerned is the sub-reflector.

It is desired to produce an antenna having a matched feed system, i.e. a feed system in which the voltage standing wave ratio (V.S.W.R.) looking into the feed system has a value as close to 1:1 as possible.

A higher V.S.W.R. is caused by energy reflections and such reflections can arise in two ways. Firstly, the reflections may be so-called 'internal' reflections, arising at various points in the feed system such as, for example, the feeder waveguide or co-axial line as the case may be, waveguide junctions, special feeder components such as diplexers or isolators and from the mouth and throat of the feed horn itself.

Such 'internal' reflections have been substantially reduced by well established matching techniques, such as the inclusion of suitable matching rises in the feeder waveguide and/or the feed horn.

A second source of reflection is that known as the 'external reflection' and is associated with energy re-entering the mouth of the feed horn after reflection from the surface of the reflector illuminated by the feed horn.

In principle, the increase in the value of the V.S.W.R., due to such 'external reflections', can be compensated by a matching device arranged in the feeder waveguide, but this seldom proves practicable. For example, if the distance between the feed horn and the directly illuminated reflector is 50 wavelengths at center band frequency, giving a total return path length of 100 wavelengths, then at a frequency of 0.25% higher this path length will be 100.25 wavelengths and the phase of the reflection as seen at the mouth of the feed horn will have changed by 90°.

An iris, which would provide an equal and opposite reflection at center band frequency to effect cancellation with the energy returned from the reflector, will now provide an additional reflection in phase quadrature. A matching iris will, therefore, worsen the overall V.S.W.R. rather than improve it, except over a very narrow bandwidth.

A known technique for compensating external reflections involves placing a small scatterer at the surface of the illuminated reflector to provide an additional reflection which, on arrival at the feed horn, combines with the reflection from the main reflector to effect a cancellation.

Figure 1:
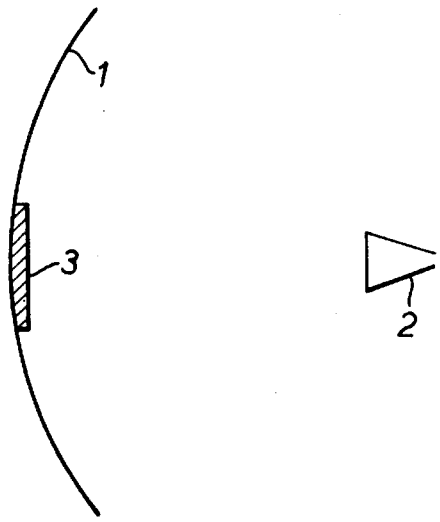
FIG. 1. PRIOR ART
FIGS. 1 and 2 show prior art arrangements.
Figure 2:
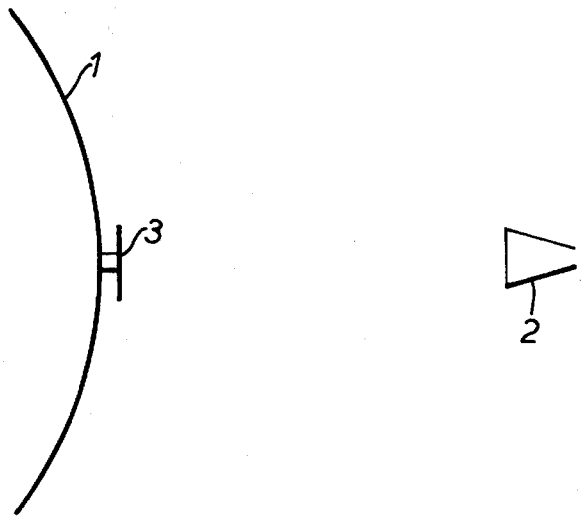
FIG. 2. PRIOR ART

A known example of this technique is the vertex plate, illustrated in FIGS. 1 and 2 of the accompanying drawings which respectively show a vertex plate arranged on a main parabolic reflector and a sub-reflector.

Referring to FIGS. 1 and 2, there is shown in each case a reflector 1 arranged to be illuminated by a feed horn 2. A vertex plate constituted by a small electrically conducting disc 3 is positioned about one quarter wavelength forward of the surface of the reflector 1.

The reflector 1, without the disc 3, has a surface hereinafter referred to as the 'nominal surface' which produces a 'nominal reflection' of energy back to the feed horn 2. The disc 3 produces an additional 'perturbation reflection' and this is arranged to be equal in magnitude and opposite in phase to the 'nominal reflection' at the mid-band frequency of the antenna.

The degree of cancellation achieved will, of course, depend upon the differential optical path length between the nominal and perturbation reflections and this will be frequency dependent. Consequently, whilst the vertex plate arrangements above provide satisfactory matching over a wider frequency band than that provided by a matching device at the feed horn aperture, this may be inadequate for some purposes, particularly where it is desired to provide matching for operation in two descrete frequency bands.

This invention seeks to provide an antenna suitable for operation in at least two frequency bands, and in which a satisfactory degree of immunity to the effects of external reflections is provided.

According to this invention, there is provided an antenna suitable for operation in at least two bands centered on respective frequencies comprising a circularly symmetric reflector arranged to be illuminated from a feed source of electromagnetic radiation, the reflector having a number, equal to the number of bands, of perturbation reflection means arranged about the center of symmetry of the reflector, each to provide a respective perturbation reflection such that at the feed source the perturbation reflections combine, at each frequency, substantially to cancel out the reflection due to the nominal profile of the reflector.

Each perturbation reflection means may be a continuous surface discontinuity or an arrangement of a plurality of discrete surface discontinuities arranged at similar distances from the center of symmetry of the reflector to provide substantially the same reflection properties as a continuous discontinuity.

Advantageously, each discontinuity is circularly symmetric about the center of symmetry of the reflector.

Preferably, each discontinuity is continuous and annular in form.

The discontinuities may be provided as discrete reflective devices mounted on the surface of the reflector, but it is preferred to provide the discontinuities as deformations in the surface of the reflector.

The surface deformations may be formed as raised portions of the surface, but in a preferred embodiment, are formed as surface depressions.

The surface deformations are conveniently provided with a profile which is cosinusoidal.

Figure 3:
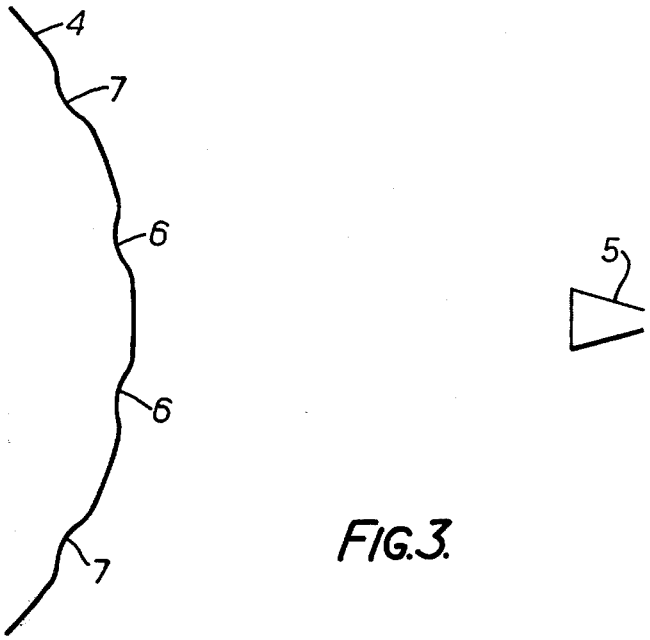
FIG. 3 is a schematic representation of a reflector and feed in accordance with the invention.
Figure 4:
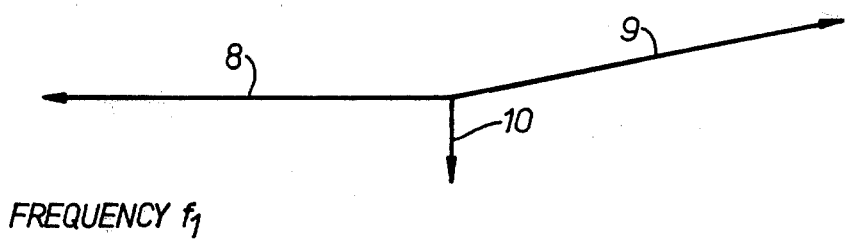
FIGS. 4 and 5 are explanatory diagrams.
Figure 4:
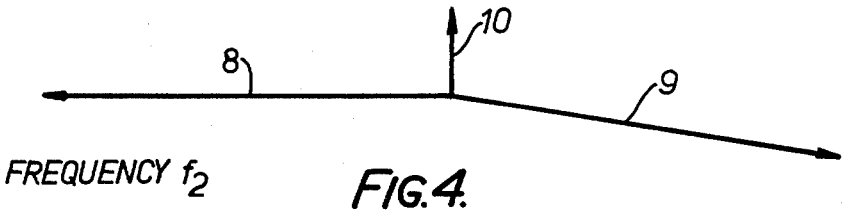
Figure 5:
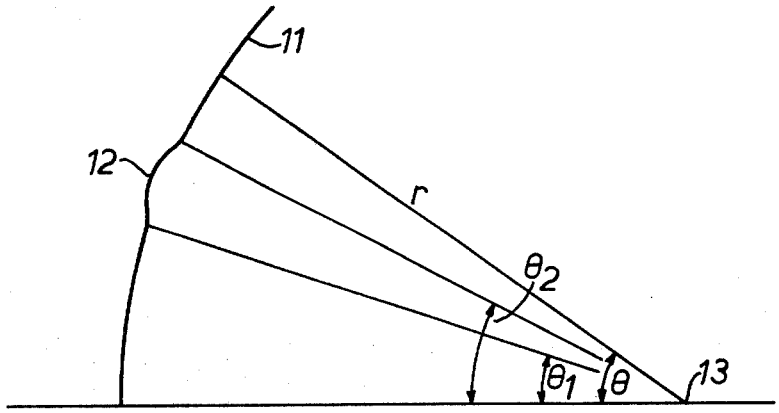

This invention will now be described further, with reference to FIGS. 3, 4 and 5 of the accompanying drawings, in which FIG. 3 is a highly schematic representation of an antenna in accordance with this invention and FIGS. 4 and 5 are explanatory diagrams.

Referring to FIG. 3, there is shown a feed horn 5 arranged to illuminate a reflector having a nominal profile 4. The feed/reflector arrangement shown is that used in a cassegrain antenna, the reflector constituting in that case a sub-reflector.

The nominal profile 4 of the reflector is provided with two concentric annular depressions 6 and 7, each having a consinusoidal profile, to be described in detail later.

In operation, the horn 5 illuminates the profile 4 with electromagnetic radiation and will receive back three separate reflection components. A first component can be considered to be obtained from the nominal profile 4, a second component from the inner annular depression 6 and a third component from the outer annular depression 7, the components from the depressions 6 and 7 being perturbation reflections. In order to provide a matched feed system, the three reflection components are arranged substantially to cancel at the feed 5.

The way in which this is achieved in the embodiment will now be described with reference to FIG. 4 of the drawings.

It is desired, in the preferred embodiment, to obtain a low V.S.W.R. at the feed 5 at the center frequencies $f_1$, $f_2$ of two discrete frequency bands. The three reflection components must, therefore, combine at the feed horn 5 substantially to cancel at each of the frequencies $f_1$ and $f_2$.

The inner annular depressions 6 is chosen to have a radius and depth of approximately such a value as to provide a match, i.e. cancellation of the nominal reflection component at a frequency $(f_1+f_2/2)$ i.e. midway between the two frequency bands.

The outer annular depression is chosen to have a radius and depth, such that the resulting reflection component at the feed horn 5 changes phase by approximately 180° when the operating frequency is changed from $f_1$ to $f_2$.

In FIG. 4, there are plotted phasor diagrams, showing the three reflection components at each of the two center band frequencies $f_1$ and $f_2$.

The phase vector 8 represents the reflection component from the nominal profile 4, the phase vector 9 represents the perturbation reflection due to the inner annular depression 6 and the phase vector 10 represents the reflection component due to the outer annular depression 7.

At the lower frequency $f_1$, the vector 9 is generally of similar size and opposite direction to the vector 8 but is offset slightly by typically 30° to 40° since the depression 6 is designed to provide an equal and opposite phase vector at a frequency mid-way between $f_1$ and $f_2$. The vector 10, due to the depression 7, is much smaller and generally approximately orthogonal to the vector 8. A vector addition of the vectors 9 and 10 will result in a phase vector substantially equal and opposite to the nominal profile vector 8.

On increasing the center frequency to $f_2$, the vector 9 will change direction by a small amount, as shown in the lower half of FIG. 4, to be an approximately equal angle below the line of the vector 8 as it was above in the upper half for the frequency $f_1$. The vector 10 will now completely reverse in phase such that vector addition of the phase vectors 9 and 10 still results in a phase vector which is substantially equal and opposite to the nominal reflection phase vector 8.

A good match giving a low value of V.S.W.R. is achieved at each of the two frequencies $f_1$ and $f_2$.

The profile of the depressions is generally cosinusoidal and the way in which this is precisely defined will be described with reference to FIG. 5 of the drawings.

In FIG. 5, a typical nominal reflector profile 11 is shown having a typical annular depression 12. For simplicity, only one half of a symmetrical arrangement is illustrated. The co-ordinate system used to define the nominal profile and the depression is centered at 13.

The profile 11 can be defined in polar co-ordinates r, $\theta$ by the expression $r(\theta)$.

The perturbed curve profile is given, therefore, by $r(\theta)+r(\theta)$ and the cosine profile of the depression 12 is given by $$\Delta r = A(1+\cos\psi)$$

where A is a constant and $$\psi = (\theta-\theta_1/\theta_2-\theta_1) \times 360°$$

$\theta_1$ and $\theta_2$ defining the extremities of the $\theta$ co-ordinate values for the depression 12.

Whilst this invention has been particularly described with respect to a two frequency band arrangement, it is equally possible to provide three depressions to provide a low V.S.W.R. at three frequencies. All that is required is that the phase vectors of the reflections due to each depression, combine to provide a resultant phase vector substantially equal and opposite to that due to the nominal profile.

The provision of the discontinuities as continuous surface deformations, e.g. annular depressions, is particularly advantageous in that the reflector can be manufactured at very little extra cost to that of manufacturing a reflector without discontinuities. The pattern of each discontinuity can be incorporated into the mould or profile tool used for the manufacture or can be written into a control programme tape for a numerically controlled machine, should the reflector be manufactured by numerically controlled machining.

Once the modifications are incorporated into the mould or tape as the case may be, the cost of subsequent processing of a reflector employing the invention would be substantially the same as that of manufacturing a reflector without profile discontinuities.

I claim:

1. An antenna suitable for operation in at least two bands centered on respective frequencies comprising a circularly symmetric reflector arranged to be illuminated from a feed source of electromagnetic radiation and characterised in that the reflector has a number, equal to the number of bands, of perturbation reflectors arranged about the center of symmetry of the reflector, which perturbation reflectors being arranged integrally with the circularly symmetric reflector and in which the radial width of the perturbation reflectors and the displacement of their reflecting surfaces from the nominal profile of the reflector are small as compared with the radial distance between different adjacent perturbation reflectors, each perturbation reflector being arranged to provide a respective perturbation reflection having a magnitude dependent on the size of that perturbation reflection and a phase dependent on the position of the perturbation reflection such that at the feed source the magnitudes and phases of the perturbation reflections combine, at each frequency, substantially to cancel out the reflection due to the nominal profile of the reflector.

2. An antenna as claimed in claim 1 and wherein each perturbation reflector is a continuous surface discontinuity.

3. An antenna as claimed in claim 1 and wherein each perturbation reflector is an arrangement of a plurality of discrete surface discontinuities arranged at similar distances from the center of symmetry of the reflector to provide substantially the same reflection properties as a continuous discontinuity.

4. An antenna as claimed in claim 2 and wherein each discontinuity is circularly symmetric about the center of symmetry of the reflector.

5. An antenna as claimed in claim 2 and wherein each discontinuity is continuous and annular in form.

6. An antenna as claimed in claim 2 and wherein the discontinuities are provided as discrete reflective devices mounted on the surface of the reflector.

7. An antenna as claimed in claim 2 and wherein the discontinuities are provided as deformations in the surface of the reflector.

8. An antenna as claimed in claim 7 and wherein the surface deformations are constituted by surface depressions.

9. An antenna as claimed in claim 7 wherein the surface deformations are provided with a profile which is cosinusoidal.

10. An antenna suitable for operation in at least two frequency bands centered on respective frequencies comprising a circularly symmetric reflector, a feed source for illuminating said reflector with electromagnetic radiation of at least two frequencies, said reflector having surface means for defining a nominal profile thereof from which is reflected a nominal reflection at each of said at least two different frequencies and first and second perturbation reflector means arranged about the center of symmetry of said reflector for producing first and second perturbation reflections at each of said at least two different frequencies, and said first and second perturbation reflector means being so constructed and arranged that the vector summation of said first and second perturbation reflections at each of said at least two different frequencies is substantially equal and opposite to the phase vector of said nominal reflection at each frequencies while at one of said frequencies, one of said perturbation reflectors is reversed in phase though generally equal in magnitude as compared to the same perturbation reflection at the other of said frequencies to cancel out the nominal reflections generally at said feed source at each of said at least two different frequencies.

* * * * *